US009051817B2

(12) United States Patent
Hales et al.

(10) Patent No.: US 9,051,817 B2
(45) Date of Patent: Jun. 9, 2015

(54) PIPE CONVEYED EXTENDABLE WELL LOGGING TOOL WITH PROTECTOR

(75) Inventors: John Hudson Hales, Frisco, TX (US); Timothy Gordon Schacherer, Lewisville, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 338 days.

(21) Appl. No.: 13/498,862

(22) PCT Filed: Sep. 28, 2009

(86) PCT No.: PCT/US2009/058658

§ 371 (c)(1),
(2), (4) Date: Jun. 5, 2012

(87) PCT Pub. No.: WO2011/037591

PCT Pub. Date: Mar. 31, 2011

(65) Prior Publication Data

US 2012/0241173 A1 Sep. 27, 2012

(51) Int. Cl.
*E21B 47/12* (2012.01)
*E21B 23/00* (2006.01)
*E21B 47/01* (2012.01)

(52) U.S. Cl.
CPC ..... *E21B 47/011* (2013.01)

(58) Field of Classification Search
USPC ..... 166/382, 254, 2, 66
See application file for complete search history.

(56) References Cited

U.S. PATENT DOCUMENTS 7,661,475 B2 * 2/2010 Sheiretov et al. ..... 166/254.2
2012/0048571 A1 * 3/2012 Radford et al. ..... 166/373

* cited by examiner

*Primary Examiner* — William P Neuder
(74) *Attorney, Agent, or Firm* — Chamberlain Hrdlicka

(57) ABSTRACT

A pipe conveyed extendable well logging assembly includes a pipe end protector for preventing wellbore debris from entering an opening at the end of the pipe from which a logging tool is extendable. Plugging of the opening is prevented to ensure proper deployment of the extendable logging tool.

22 Claims, 13 Drawing Sheets

PIPE CONVEYED EXTENDABLE WELL LOGGING TOOL WITH PROTECTOR

This application is the U.S. National Stage under 35 U.S.C. 371 of International Patent Application No. PCT/US2009/058658 filed Sep. 28, 2009, entitled "Pipe Conveyed Extendable Well Logging Tool With Protector."

BACKGROUND

During the drilling and completion of oil and gas wells, it may be necessary to engage in ancillary operations, such as evaluating the production capabilities of formations intersected by the well bore. For example, after a well or well interval has been drilled, zones of interest are often measured or tested to determine various formation and fluid properties. These tests are performed in order to determine whether commercial exploitation of the intersected formations is viable and how to optimize production. The acquisition of accurate data from the well bore is critical to the optimization of hydrocarbon wells. This well bore data can be used to determine the location and quality of hydrocarbon reserves, whether the reserves can be produced through the well bore, and for well control during drilling operations.

The collected data is contained in a survey or "log," then analyzed to determine one or more properties of the formation, sometimes as a function of depth. Many types of formation evaluation logs, e.g., mechanical, resistivity, acoustic and nuclear, are recorded by appropriate downhole instruments supported by a housing. The housing may include a sonde with the instruments and a cartridge with associated electronics to operate the instruments in the sonde. Such a logging tool is lowered into the well bore to measure properties of the formation. To reduce logging time, a combination of logging tools may be lowered in a single logging run.

Often, logging tools are lowered into vertical well bores by wireline. Gravity moves the logging tools into the well bore, and the wireline is used for electrical communication and support for pulling the logging tools out of the well bore. Logging deep, extended, deviated or horizontal wells can be problematic with wireline. The wireline provides no driving force for pushing, rather than pulling, logging tools further into the well bore. To log such well bores, tubulars such as coiled tubing or drill pipe transport logging tools into the well bore. Pipe, tubing, tubular and like terms may all be used to reference such a conveyance. In some cases, wireline logging tools are adapted for drill pipe deployment. The logging tools are coupled to the operational end of the tubular and may be extendable from the tubular.

Pipe conveyed well logging tools are relatively fragile as compared to the drill string from which they are deployed. Further, extendable well logging tools are exposed to the downhole environment. When a borehole is drilled, it is seldom smooth and regular. It has cave-ins, erosions, washouts, shales and clays that squeeze into the hole, ledges, protrusions and other rugosity. Wellbore debris is also present. As the pipe is moved downhole to convey the logging tool, wellbore debris can collect in the open end of the pipe, thereby plugging the tool deployment end. The debris can cause damage to the logging tools. The plugged opening can also cause unwanted adjustments of the expected distance between the extended logging tool and the drill pipe, thereby affecting the accuracy of the depth-dependent measurements and formation properties derived therefrom.

These and other limitations of the prior art are overcome by the embodiments and principles taught herein.

BRIEF DESCRIPTION OF THE DRAWINGS

For a detailed description of exemplary embodiments of the invention, reference will now be made to the accompanying drawings in which.

DETAILED DESCRIPTION

Figure 1:
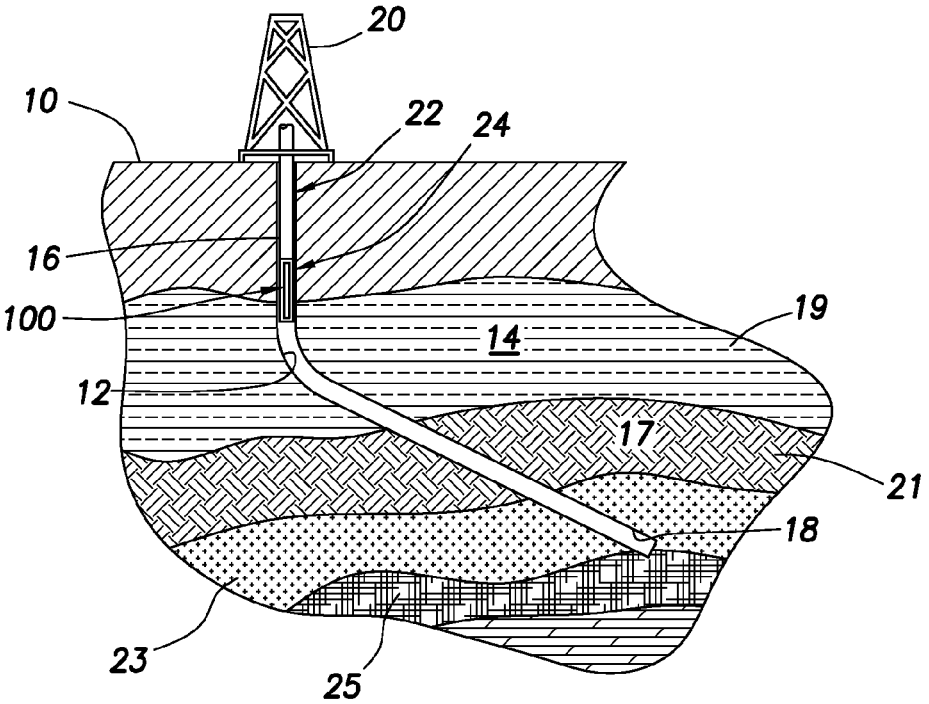
FIG. 1 is a schematic view, partly in cross-section, of an operational environment for a pipe conveyed extendable well logging apparatus in accordance with principles disclosed herein.

In the drawings and description that follow, like parts are typically marked throughout the specification and drawings with the same reference numerals. The drawing figures are not necessarily to scale. Certain features of the disclosure may be shown exaggerated in scale or in somewhat schematic form and some details of conventional elements may not be shown in the interest of clarity and conciseness. The present disclosure is susceptible to embodiments of different forms. Specific embodiments are described in detail and are shown in the drawings, with the understanding that the present disclosure is to be considered an exemplification of the principles of the disclosure, and is not intended to limit the disclosure to that illustrated and described herein. It is to be fully recognized that the different teachings of the embodiments discussed below may be employed separately or in any suitable combination to produce desired results.

In the following discussion and in the claims, the terms "including" and "comprising" are used in an open-ended fashion, and thus should be interpreted to mean "including, but not limited to . . . ". Unless otherwise specified, any use of any form of the terms "connect", "engage", "couple", "attach", or any other term describing an interaction between elements is not meant to limit the interaction to direct interaction between the elements and may also include indirect interaction between the elements described. Reference to up or down will be made for purposes of description with "up", "upper", "upwardly" or "upstream" meaning toward the surface of the well and with "down", "lower", "downwardly" or "downstream" meaning toward the terminal end of the well, regardless of the well bore orientation. In addition, in the discussion and claims that follow, it may be sometimes stated that certain components or elements are in fluid communication. By this it is meant that the components are constructed and interrelated such that a fluid could be communicated between them, as via a passageway, tube, or conduit. The various characteristics mentioned above, as well as other features and characteristics described in more detail below, will be readily apparent to those skilled in the art upon reading the following detailed description of the embodiments, and by referring to the accompanying drawings.

Referring initially to FIG. 1, a well bore 12 has been drilled into a formation 14, and includes an upper substantially vertical portion 16 and a lower deviated or horizontal portion 17 with a terminal end 18. The formation 14 also includes different layers 19, 21, 23, 25 possibly representing well zones of interest. Surface equipment 20 at a surface 10 overlays the borehole 12 and couples to and operates a tubular conveyance 22. As previously described, the tubular conveyance 22 may also be referred to as drill pipe, coiled tubing or other downhole tubulars. The drill pipe 22 includes a garage 24 at its lower end. The garage 24 contains extendable and retractable logging tool assembly 100. In some embodiments, the logging tool 100 includes multiple logging devices. The drill pipe 22 conveys the logging tool assembly 100, fully retracted inside the garage 24, into the vertical well portion 16.

Though embodiments of the logging tool assembly 100 will described throughout the present disclosure, an exemplary embodiment of the logging tool 100 includes a battery operated logging tool string that records data in memory. Logging data is collected and stored into the memory as the drill pipe is tripped out of the well.

Figure 2:
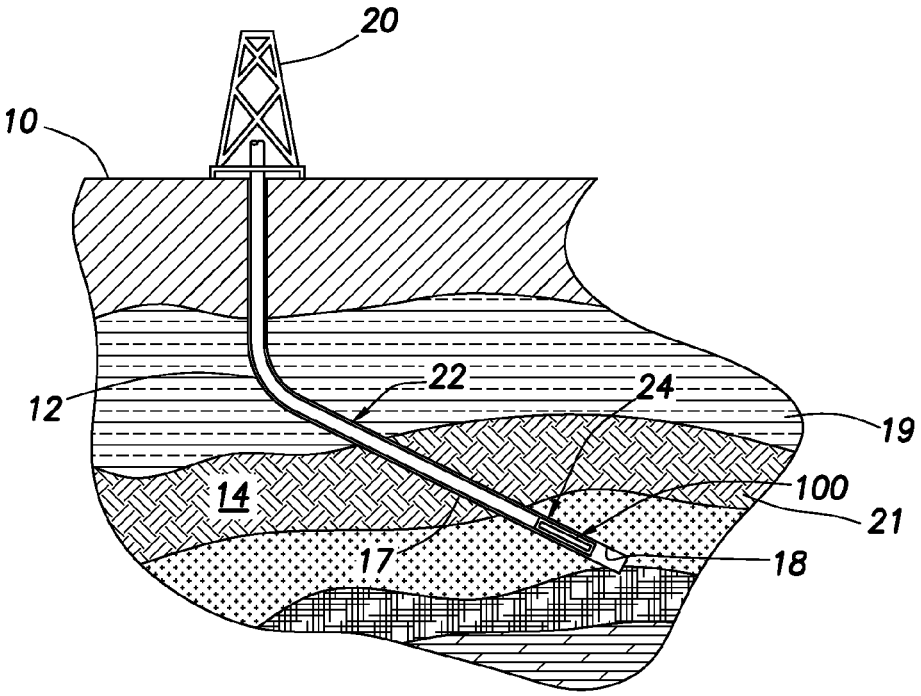
FIG. 2 is the pipe conveyed extendable well logging apparatus of FIG. 1 positioned below a well zone of interest.

Referring next to FIG. 2, the surface equipment 20 continues to operate to convey the drill pipe 22 and the logging tool assembly 100 further into the well bore 12. Specifically, the drill pipe 22 is moved into the deviated or horizontal well portion 17 such that the logging tool assembly 100 is directed toward the well bore end 18. The logging tools 100 remain retracted in the garage 24 for protection and to maintain a power down state to preserve stored operational energy, e.g., battery power. The logging tools 100 are conveyed to a location below a predetermined well bore zone of interest, for example the formation layer 21 and/or the formation layer 19.

Figure 3:
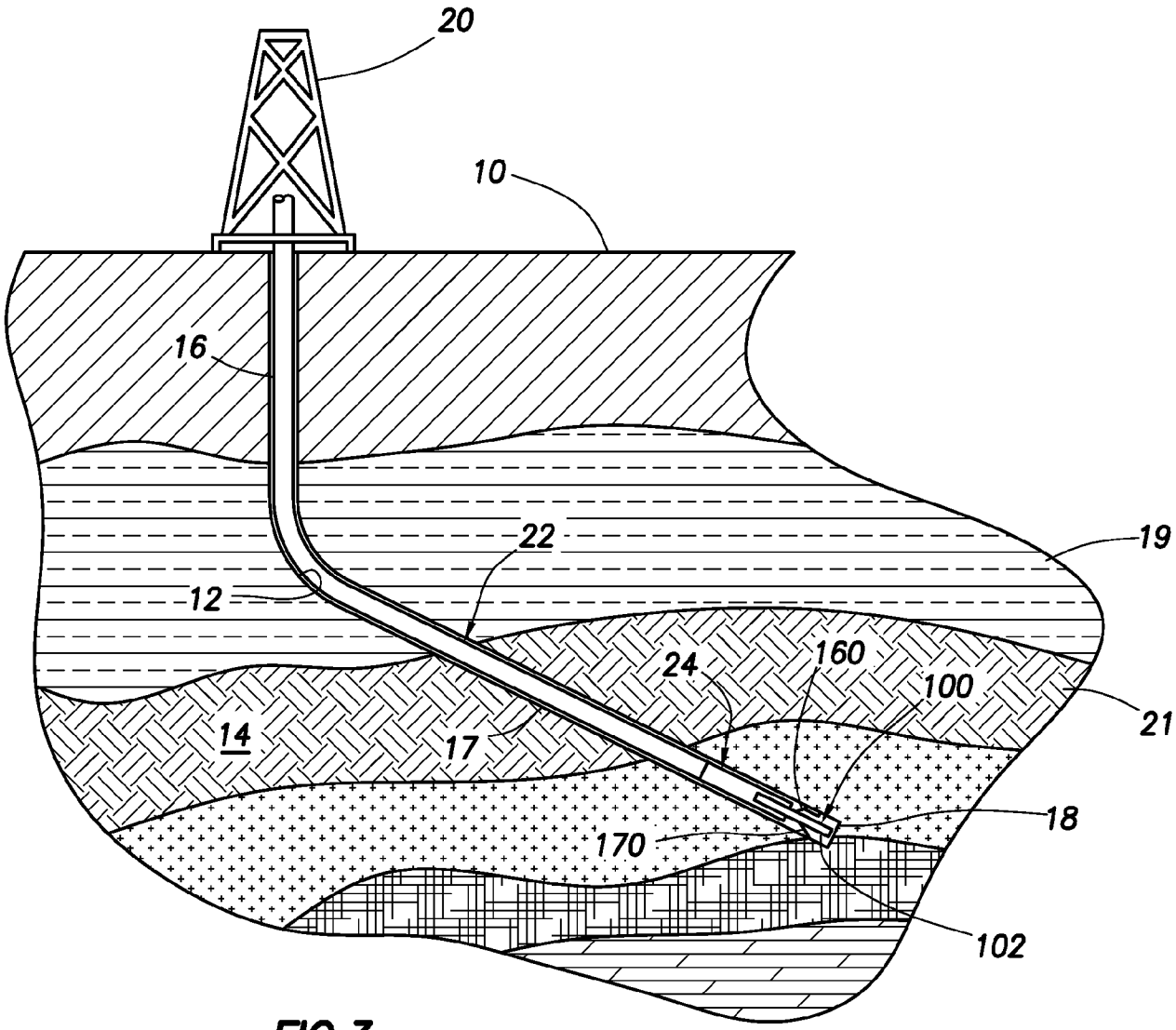
FIG. 3 is the pipe conveyed extendable well logging apparatus of FIGS. 1 and 2 in an extended and deployed position.

Referring now to FIG. 3, the logging tool assembly 100 is deployed from the garage 24. Deployment of the logging assembly 100 may include one or more of extending a tool body 102 axially out and away from the garage 24, powering up the tool assembly 100, radially extending logging devices 160, 170 from the tool body 102 via motors or other drive mechanisms, and communicating control signals and electronic data between and among the controllers, electronics, memory, sensors, and logging devices as more fully explained herein. A deployed and activated logging tool assembly 100 is now located below a well zone to be logged.

Figure 4:
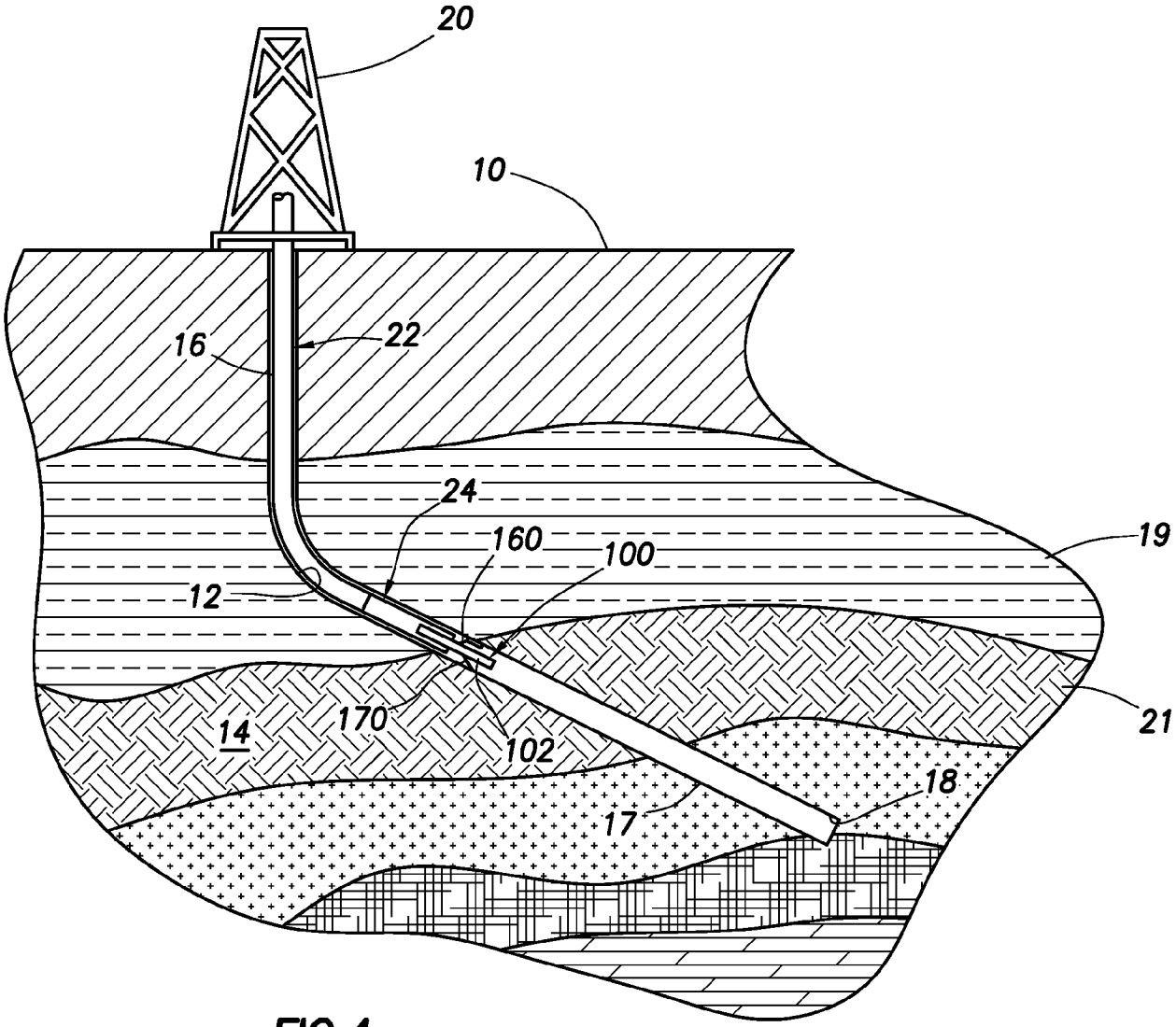
FIG. 4 is the pipe conveyed extendable well logging apparatus of FIGS. 1-3 being moved by the drill pipe through the well zone of interest for logging.
Figure 5:
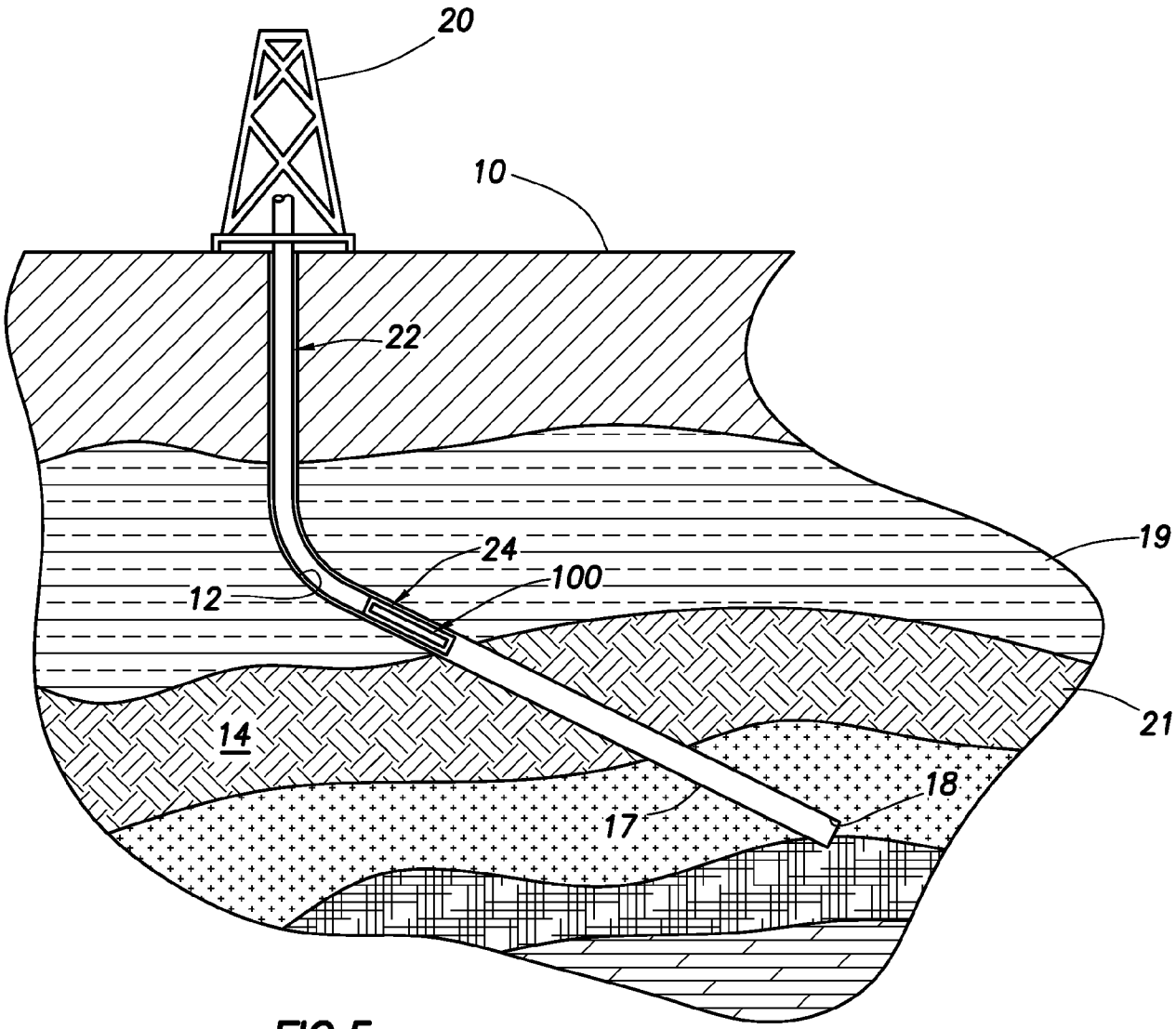
FIG. 5 is the pipe conveyed extendable well logging apparatus of FIGS. 1-4 in a retracted position after logging the well zone of interest.

Referring to FIG. 4, the surface equipment 20 is operated to pull the drill pipe 22 up through the borehole 12 and thereby move the logging assembly 100 through the zone of interest 21. The logging assembly 100 and the logging devices 160, 170 are operated to take measurements and record a log of the zone 21. In some embodiments, the logging assembly 100 is pulled further up the borehole 12 to log the formation zone 19 and any other zones of interest. In some embodiments, as shown in FIG. 5, the logging assembly 100 is retracted back into the garage 24 by radially retracting the logging devices 160, 170 and axially retracting the tool body 102 into the garage 24. Furthermore, the logging assembly 100 may be powered down to preserve battery power. In some embodiments, the retracted tool 100 as shown in FIG. 5 can be tripped out of the well bore 12 using the drill pipe 22. In other embodiments, the tool 100 can be re-deployed to execute a well logging repeat section of the formation zone 21.

Figure 6:
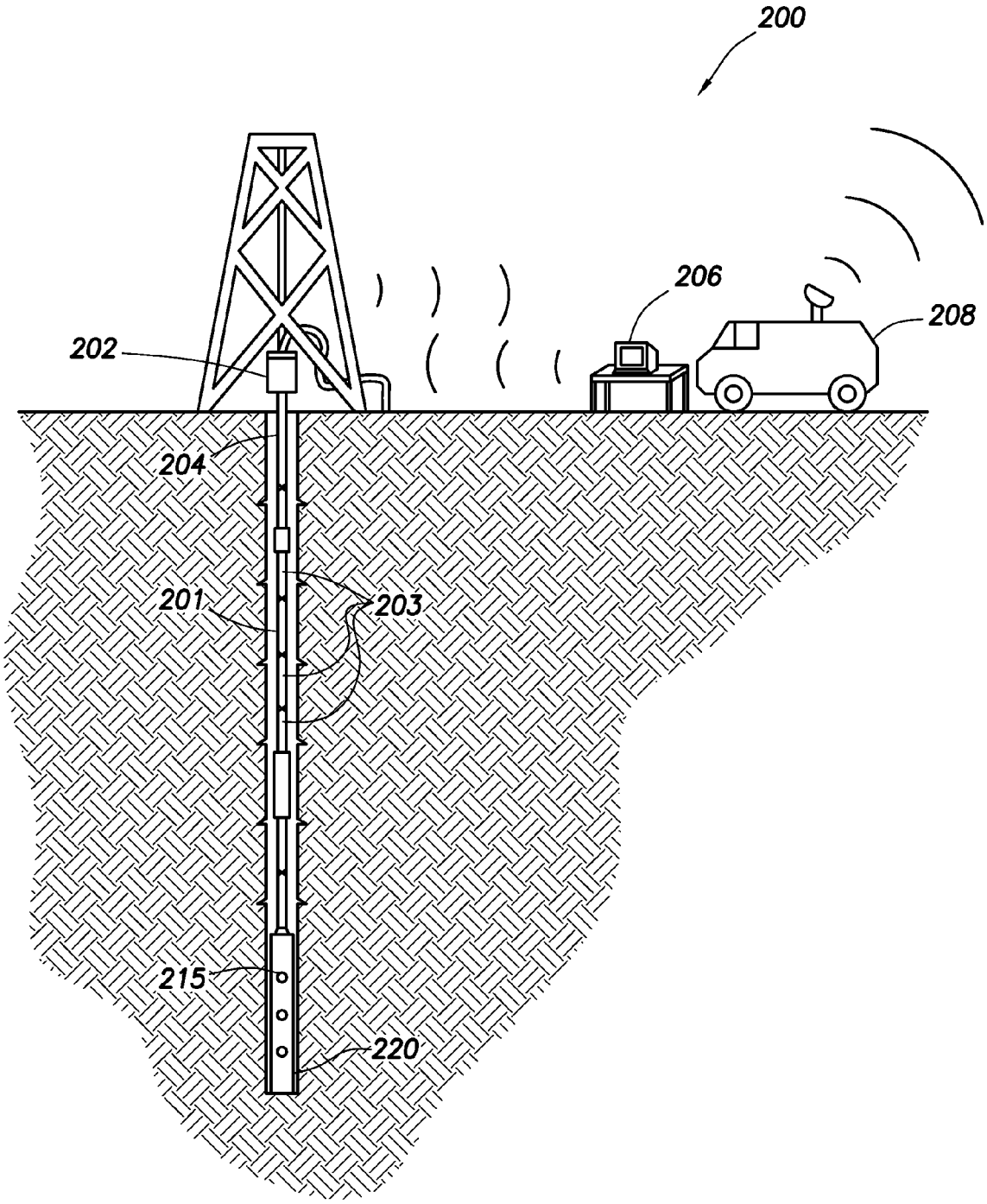
FIG. 6 is a schematic view, partly in cross-section, of a pipe conveyed logging tool disposed on a wired drill pipe coupled to a telemetry network.

Referring to FIG. 6, a telemetry network 200 is shown. A pipe conveyed logging tool 220 is coupled to a drill string 201 formed by a series of wired drill pipes 203 connected for communication across junctions using communication elements as described below. It will be appreciated that work string 201 can be other forms of conveyance, such as coiled tubing or wired coiled tubing. A top-hole repeater unit 202 is used to interface the network 200 with logging control operations and with the rest of the world. In one aspect, the repeater unit 202 is operably coupled with pipe control equipment 204 and transmits its information to the drill rig by any known means of coupling information to a fixed receiver. In another aspect, two communication elements can be used in a transition sub. A computer 206 in the rig control center can act as a server, controlling access to network 200 transmissions, sending control and command signals downhole, and receiving and processing information sent up-hole. The software running the server can control access to the network 200 and can communicate this information, in encoded format as desired, via dedicated land lines, satellite link (through an uplink such as that shown at 208), Internet, or other means to a central server accessible from anywhere in the world. The logging tool 220 is shown linked into the network 200 for communication of data gathered by logging devices and sensors 215 along its conductor path and along the wired drill string 201. The telemetry network 200 may combine multiple signal conveyance formats (e.g., mud pulse, fiber-optics, acoustic, EM hops, etc.). It will also be appreciated that software/firmware may be configured into the tool 220 and/or the network 200 (e.g., at surface, downhole, in combination, and/or remotely via wireless links tied to the network).

Figure 7:
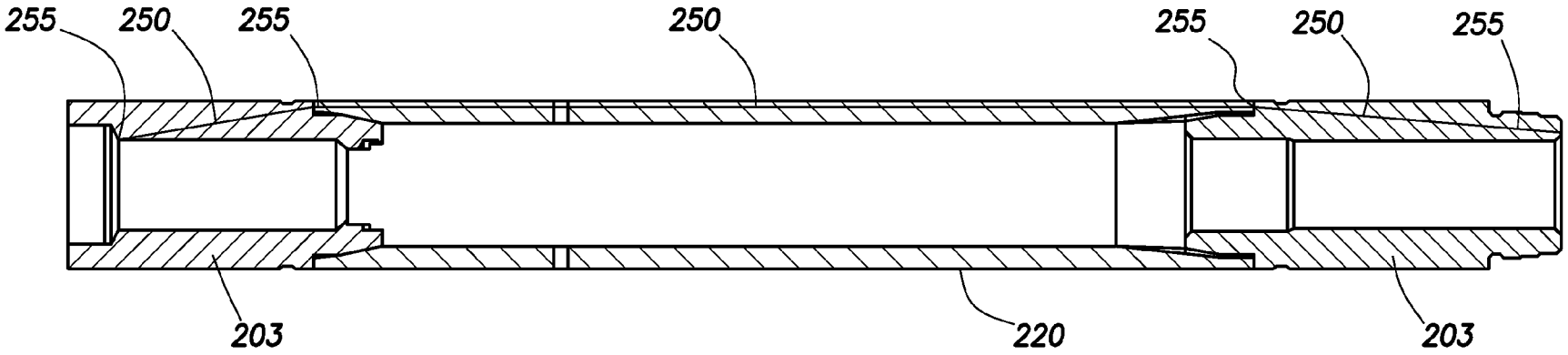
FIG. 7 is a cross-section view of a section of wired drill pipe.

Referring to FIG. 7, a section of the wired drill string 101 is shown including the tubular tool body 220. Conductors 250 traverse the entire length of the tubular body 220. Portions of wired drill pipes 203 may be subs or other connections means. In some embodiments, the conductor(s) 250 comprise coaxial cables, copper wires, optical fiber cables, triaxial cables, and twisted pairs of wire. The ends of the wired subs 203 are configured to communicate within a downhole network as described herein.

Communication elements 255 allow the transfer of power and/or data between the sub connections and through the tubular 220. The communication elements 255 may comprise inductive couplers, direct electrical contacts, optical couplers, and combinations thereof. The conductor 250 may be disposed through a hole formed in the walls of the outer tubular members of the body 220 and pipes 203. In some embodiments, the conductor 250 may be disposed part way within the walls and part way through the inside bore of the tubular members or drill pipes. In some embodiments, a coating may be applied to secure the conductor 250 in place. In this way, the conductor 250 will not affect the operation of the tool 220. The coating should have good adhesion to both the metal of the pipe and any insulating material surrounding the conductor 250. Useable coatings 312 include, for example, a polymeric material selected from the group consisting of natural or synthetic rubbers, epoxies, or urethanes. Conductors 250 may be disposed on the subs using any suitable means.

Figure 8:
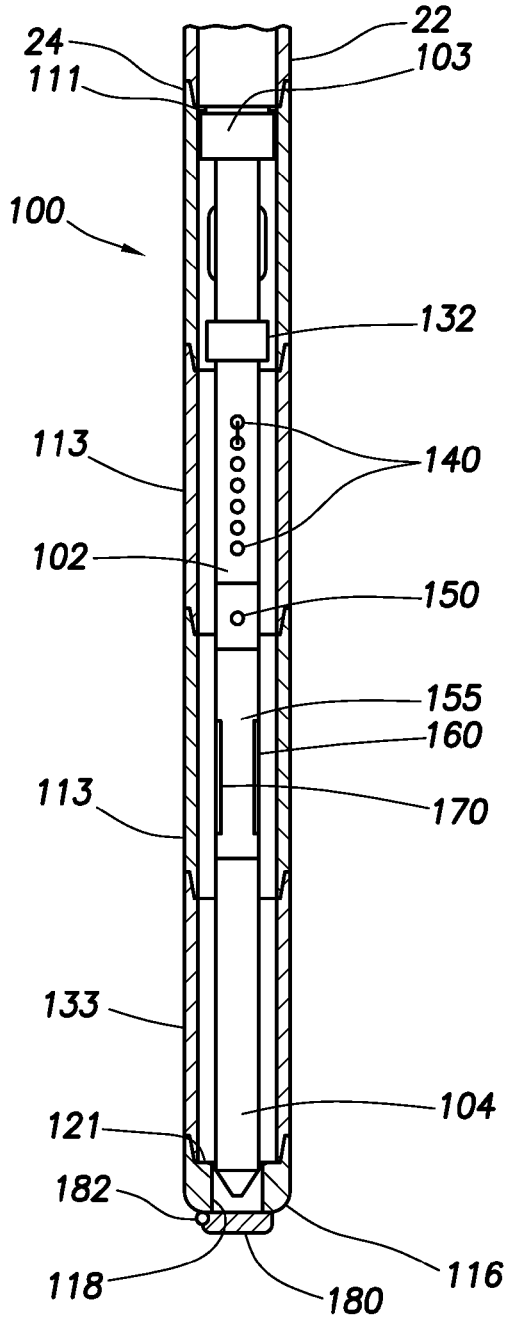
FIGS. 8-14 are partial cross-section views showing the well logging and garage assembly of FIGS. 1-5 in greater detail to illustrate various logging tool protector embodiments with flappers and closure mechanisms.

Referring now to FIG. 8, an enlarged view of the logging assembly 100 is shown. The drill pipe 22 couples to the garage 24, which are cut away to reveal the logging tool body 102 retracted within the garage 24. In some embodiments, the garage 24 comprises extension segments 113. An upper end 103 of the tool body 102 is retracted and housed in the garage 24. An upper stop ring 111 axially retains the tool body 102 in the garage 24. A stop collar 132 is provided for deployed retention or latching. Below the stop collar 132 is a logging sensor array 140. Below the position sensor array 140 is an additional logging sensor 150. Below the sensor 150 is a logging device sub 155 including an extendable sensor pad 160 and an extendable back up arm 170. The lower end 104 of the tool body 102 may contain other features of the logging tool 100, including electronics. A lower extension segment 133 includes a lower end 116 having a lower stop ring or latch sub 121 and an opening or throughbore 118 for receiving the logging tool body 102.

During deployment, as shown in FIGS. 2 and 3, it is the opening 118 that is susceptible to entry or plugging by wellbore debris. Various embodiments of a protector or closure mechanism for opening 118 are described below.

Figure 10:
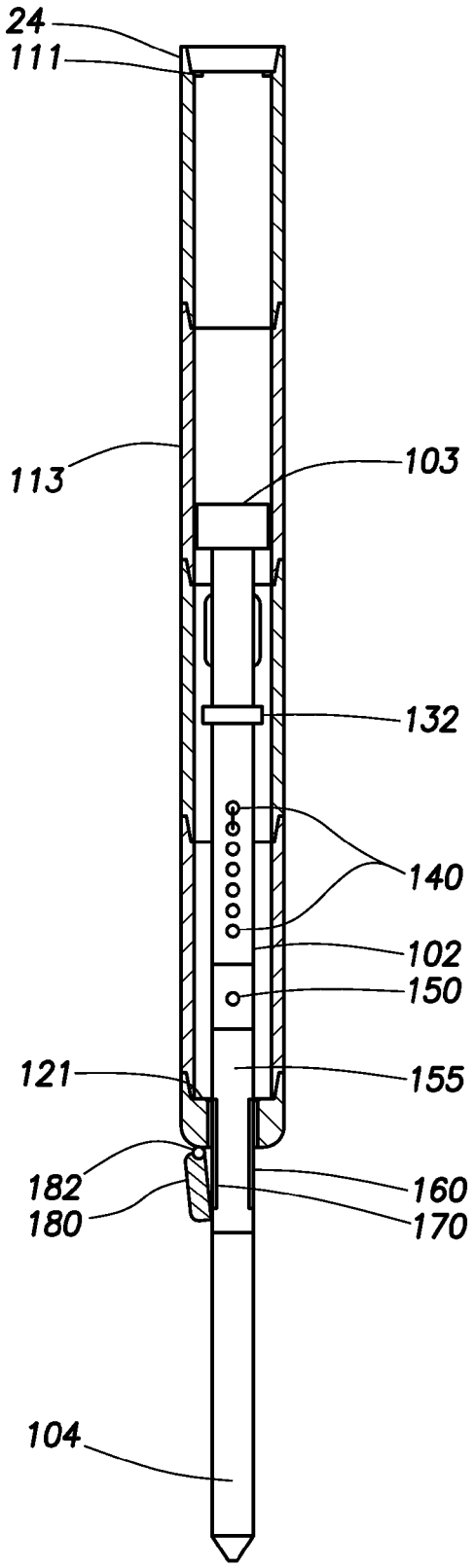

Still referring to FIG. 8, a protector or closure mechanism 180 includes a flapper rotatably coupled to the end 116 at a pivot 182. In some embodiments, the flapper 180 is releasably secured in a closed position to the end 116 until the logging tool 104 extends through the opening 118 and forces the flapper 180 open, as shown in FIG. 10. In the closed position, the flapper 180 isolates the logging tool 104 from the wellbore and prevents intrusion into the garage 24 of wellbore debris.

Figure 9:
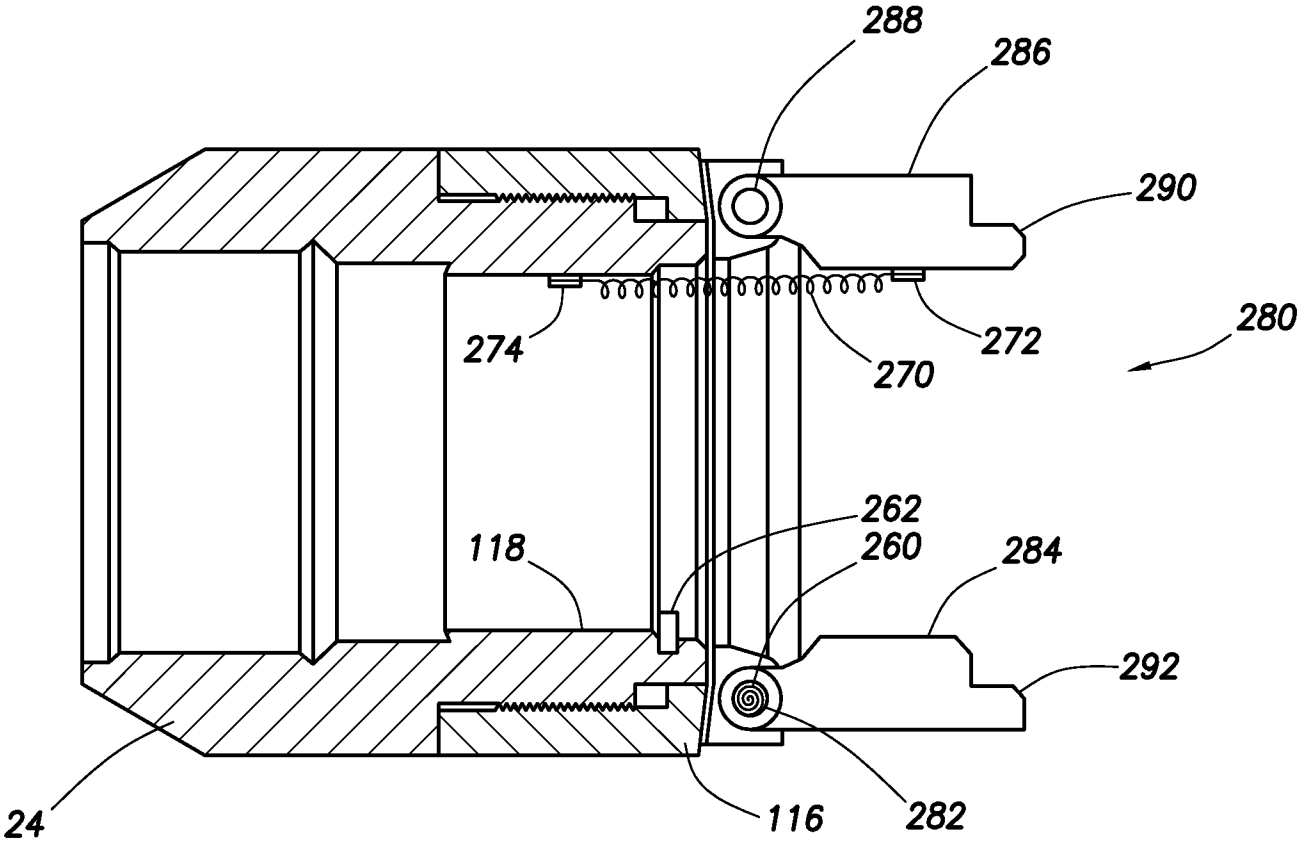

Referring to FIG. 9, other embodiments include a double flapper system 280. A first flapper 284 is rotatably coupled to the end 116 at 282 and a second flapper 286 is rotatably coupled to the end 116 at 288. Each flapper is provided with an interlocking ledge 290, 292. In some embodiments, the interlocking ledges 290, 292 are releasably secured, then broken apart and opened by force from the logging tool 104. In some embodiments, any of the flappers (including the flapper 180 of FIG. 8) are provided with a spring 270 coupled between the flapper at 272 and the end 116 at 274. The spring 270 may provide a biasing force to the closed position (FIG. 8) in some embodiments, or an opening force to the open position when a trip mechanism is activated (FIG. 9) in other embodiments. In further embodiments, any of the flappers 180, 284, 286 may include a worm gear or motor 260 as shown at rotatable coupling 282. The worm gear or motor 260 is coupled to the mechanism 262 that is tripped when the logging tools 204 engage it, thereby signaling the closure mechanism to open via the drive mechanism 260. Other closure devices may also be coupled to the end 116 in these manners, to close or open the closure mechanism as required to isolate the tools or release them for extension.

Figure 11:
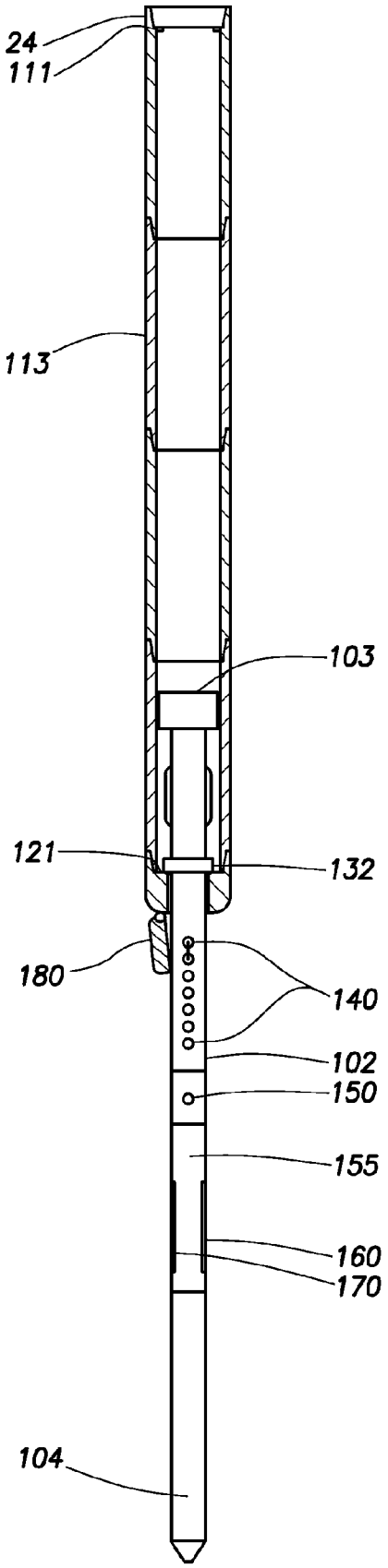

Referring again to FIG. 10, the logging tool body 102 is being moved downward by a deployment force. The lower end 104 slides through and out the opening 118 into the surrounding well bore. The closure mechanism 180 rotates about the pivot 182 to open, either in response to the logging tools 104 or via the trip and drive mechanisms as described. As shown in FIG. 11, the stop collar 132 ultimately lands on the stop ring 121 and latches thereto to secure the tool body 102. The logging tool body 102 is now fully extended. In this manner, the logging tools are removed from the metallic environment of the drill pipe garage, which negatively impacts operation of the logging tools.

Figure 12:
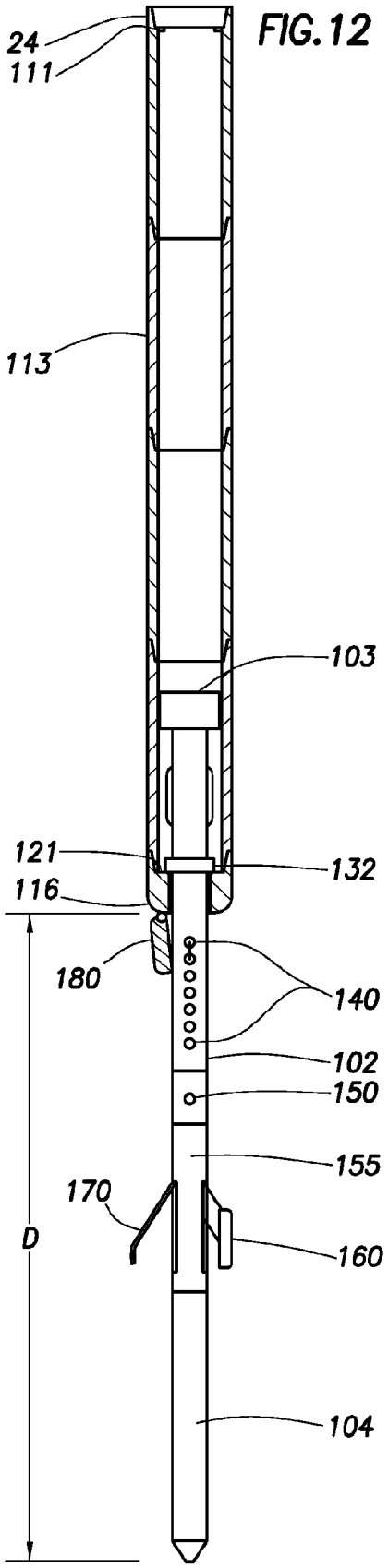

Referring to FIG. 12, the sensor pad 160 and the back up arm 170 are activated and extended by motors coupled thereto, or by other similar drive mechanisms. The logging tool assembly 100 is now fully extended and deployed, with a length D representing the fully extended length of the tool body end 104 with respect to the drill string end 116. The sensor pad 160 may engage the borehole wall, and the back up arm 170 will provide an opposing force to ensure the sensor pad remains engaged with the borehole wall. The logging tools are ready to log and record data as the drill pipe is tripped out of the hole, as described with reference to FIGS. 3 and 4.

Figure 13:
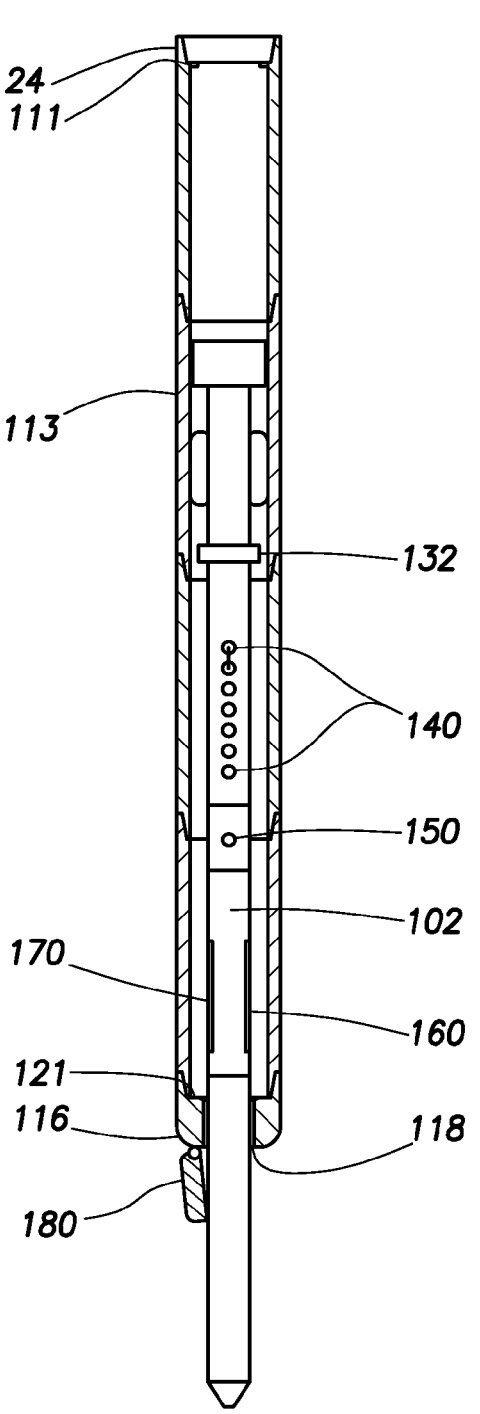
Figure 14:
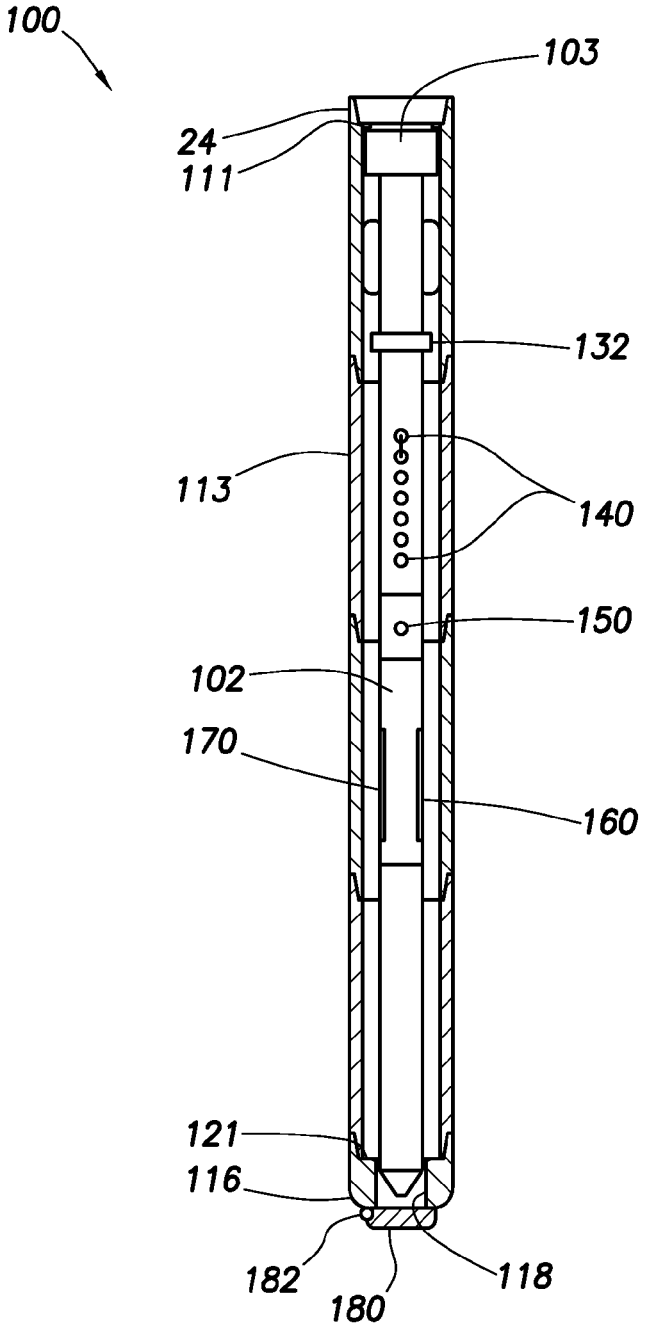

In some embodiments, particularly with the passive protector embodiments described herein that are not retractable or closeable upon retraction of the logging tools, the logging tools 104 and the protector 180 are tripped completely out of the borehole in the position shown in FIG. 12. In other embodiments, the protector is active and may be retracted or closed, as described with reference to FIG. 9. Referring to FIG. 13, the tool body 102 may be retracted into the garage 24 back through the opening 118. As shown in FIG. 14, the closure member 180 is retracted or closed about the coupling 182 via the mechanisms described herein.

Figure 15:
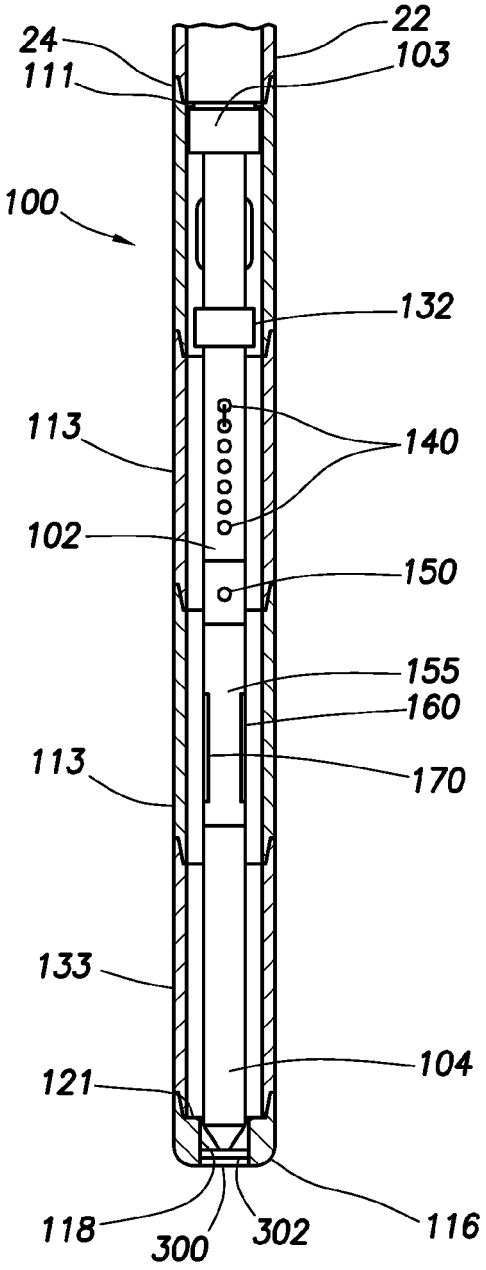
FIGS. 15 and 16 are partial cross-section views showing additional logging tool protector embodiments with a moveable closure member.
Figure 16:
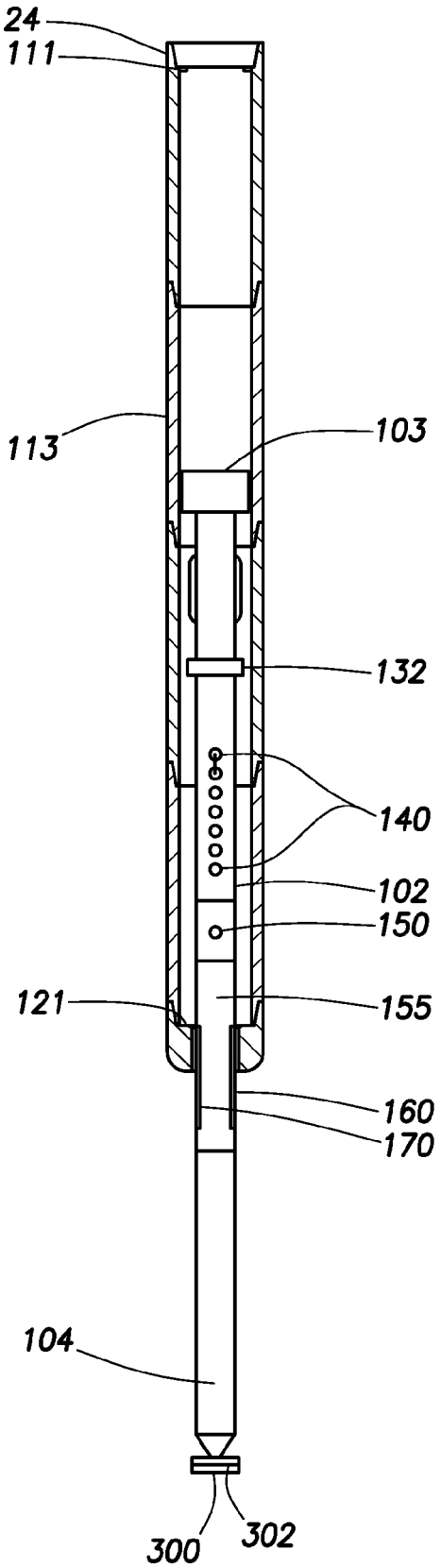

Referring now to FIGS. 15 and 16, further embodiments include a protector 300. The protector 300 includes a solid member that fills the opening 118. The protector 300 includes an o-ring 302 for sealing and axial movement of the protector 300. The protector 300 provides a barrier isolating wellbore debris from the tool assembly 100 while it is being tripped downhole and deployed. The protector 300 is pushed out of the opening 118 by extension of the tool body 102, aided by the o-ring 302, as shown in FIG. 16.

Figure 17:
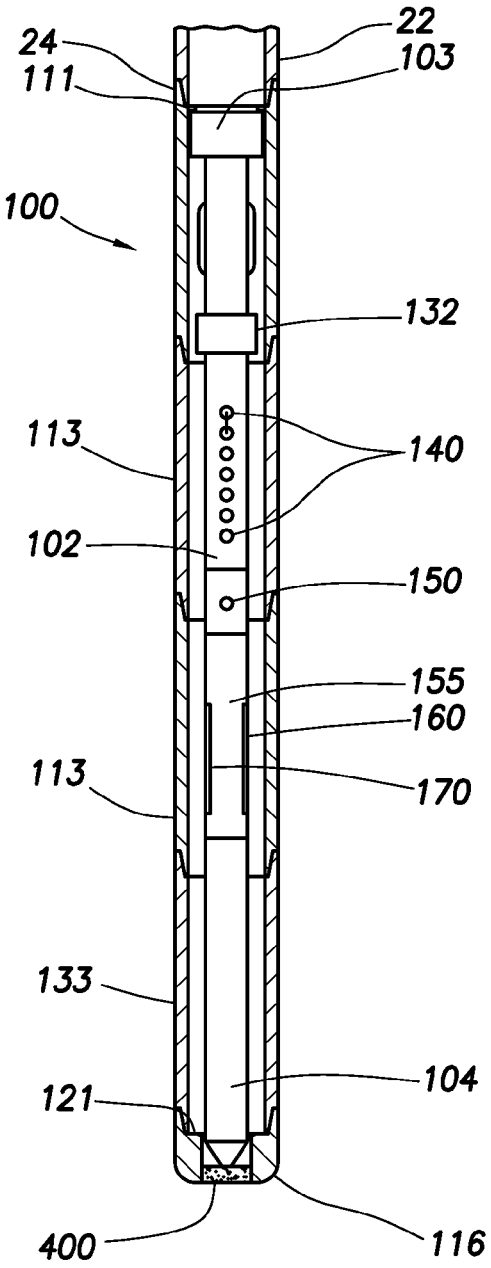
FIGS. 17 and 18 are partial cross-section views showing further logging tool protector embodiments with a destructible closure member.
Figure 18:
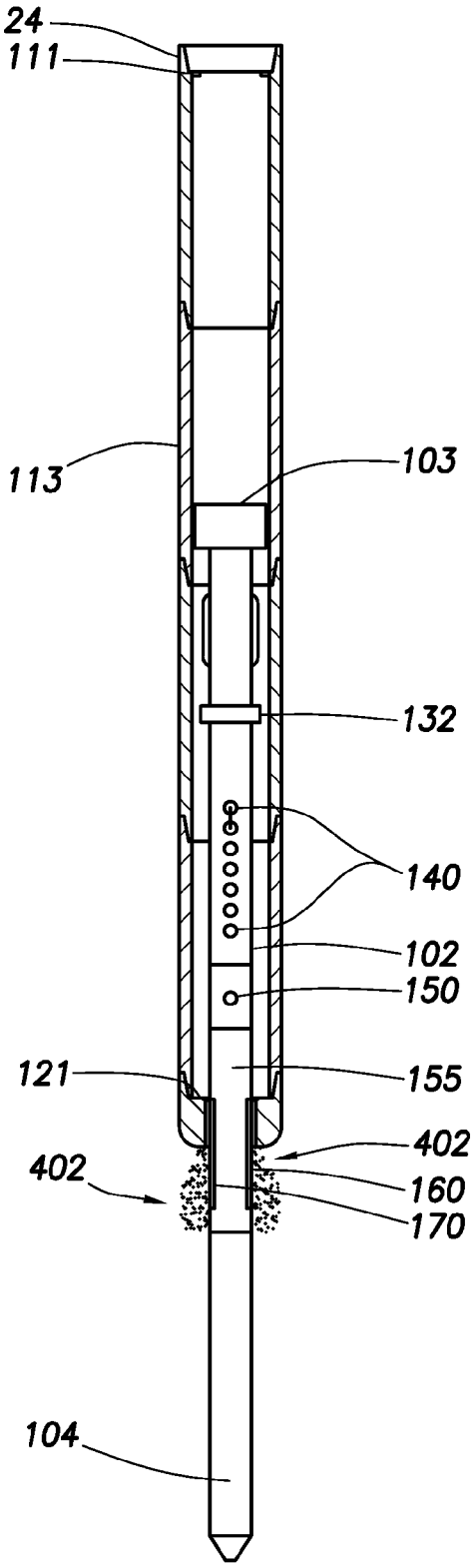

Referring now to FIGS. 17 and 18, further embodiments include a plug 400. The plug 400 includes a dissolvable, destructible, frangible or other material that can be destroyed. The plug 400 provides a barrier isolating wellbore debris while the pipe 22 and assembly 100 are deployed. In some embodiments, the plug 400 is dissolved when the pipe and tool assembly are placed in the desired well location for tool deployment. The plug 400 may be dissolved by well fluids, temperature, as a function of time, or combinations thereof, as shown in FIG. 18. In other embodiments, the plug 400 is destructed by contact with the tool body 102 or other structure in the wellbore. The dissolved or destructed plug 400 will dissipate from the opening 118 as remnants 402.

Figure 19:
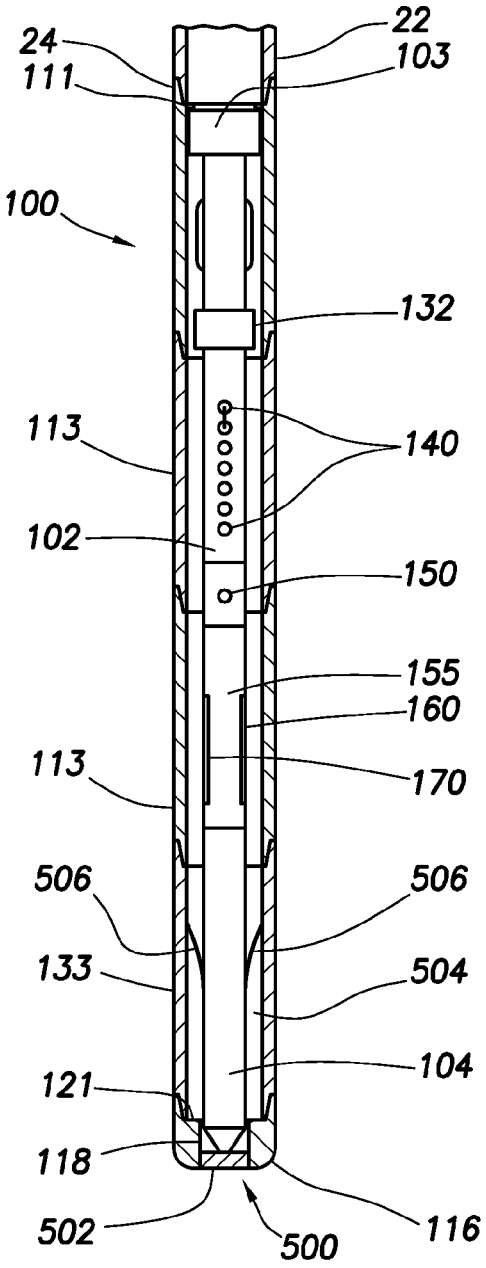
FIGS. 19 and 20 are partial cross-section views showing further logging tool protector embodiments with a closure member moveable in response to hydrostatic pressure applied by breaching an atmospheric chamber.
Figure 20:
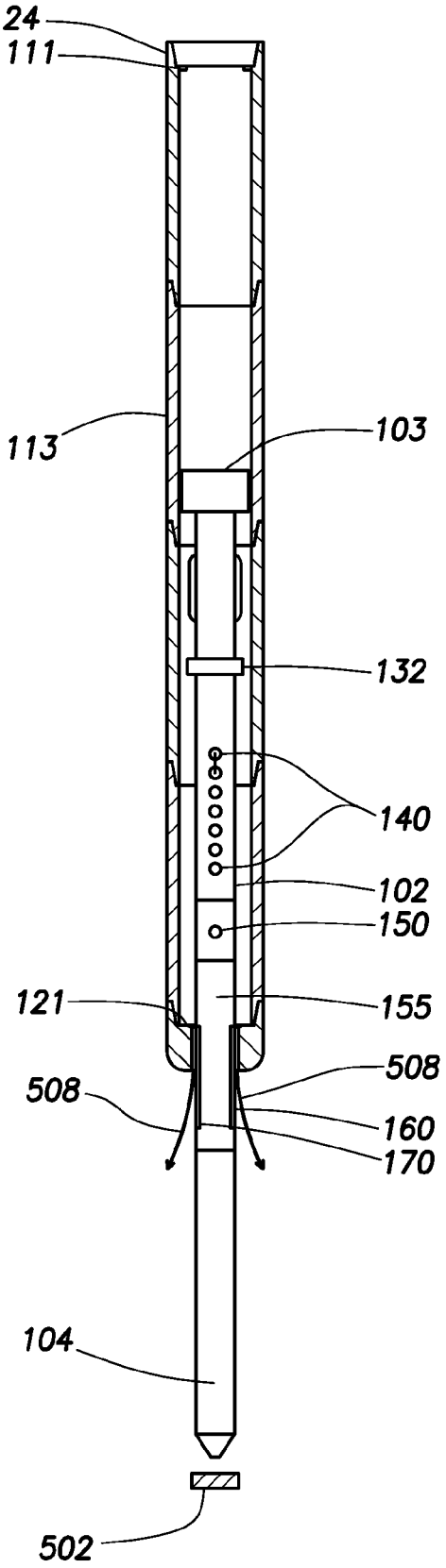

Referring now to FIGS. 19 and 20, further embodiments include a protector assembly 500. The protector assembly 500 includes a closure device 502 that fills the opening 118 and is held in position by an atmospheric chamber 504 created by barrier 506. The closure device 502 provides a barrier isolating wellbore debris while the assembly 100 is deployed. As the tool body 102 is extended through the garage 24 as shown in FIG. 19, the barrier 506 is breached and the closure device 502 is moved out of the opening 118 by hydrostatic pressure 508.

The various embodiments described herein illustrate protectors or closure members for preventing wellbore debris from plugging the opening of the pipe garage where the logging tools are extended. Wellbore debris intrusion can cause logging tool damage or improper extension of the logging tool, which affects the depth dependent measurements of the logging tool.

In some embodiments, a pipe conveyed well logging assembly includes a downhole pipe including a garage with an opening, a logging tool disposed in the garage and extendable through the opening, and a protector disposed adjacent the opening and isolating the logging tool from well debris. The protector may include at least one flapper rotatably coupled to the garage to cover the opening. The protector may include a solid member filling the opening.

In some embodiments, a pipe conveyed well logging assembly includes a downhole pipe including a garage with an opening, a logging tool disposed in the garage and extendable through the opening, and a moveable closure mechanism to isolate the logging tool from well debris in a first position, and expose the logging tool to the well in a second position. The closure mechanism may include two interlocking flappers. The closure mechanism may be is biased to the first position when the logging tool is retracted, and releases to the second position in response to extension of the logging tool. The closure mechanism may include a drive mechanism to open the closure mechanism to the second position. The drive mechanism may include a worm gear, a spring, a motor, or combinations thereof. The closure mechanism may be moveable from the second position to the first position.

In some embodiments, a method of deploying a pipe conveyed well logging assembly includes disposing in a borehole a pipe including a garage housing a logging tool, lowering the logging tool below a selected well zone using the pipe, and isolating the logging tool from the borehole using a closure member to prevent borehole debris from entering the garage. The method may further include extending the logging tool from the garage and moving the closure member with the logging tool to expose the logging tool to the borehole. The method may further include destroying the closure member and then extending the logging tool from the garage through an opening left by the closure member. The method may further include moving the closure member to expose an opening and the logging tool and then extending the logging tool from the garage through the opening. The method may further include releasing the closure member to expose the logging tool to the borehole, extending the logging tool from the garage, and moving the pipe and the logging tool up the borehole to log the well zone. The method may further include retracting the logging tool back into the garage and moving the closure member to re-isolate the retracted logging tool from borehole debris.

The embodiments set forth herein are merely illustrative and do not limit the scope of the disclosure or the details therein. It will be appreciated that many other modifications and improvements to the disclosure herein may be made without departing from the scope of the disclosure or the inventive concepts herein disclosed. Because many varying and different embodiments may be made within the scope of the inventive concept herein taught, including equivalent structures or materials hereafter thought of, and because many modifications may be made in the embodiments herein detailed in accordance with the descriptive requirements of the law, it is to be understood that the details herein are to be interpreted as illustrative and not in a limiting sense.

What is claimed is:

1. A pipe conveyed well logging assembly comprising:
- a downhole pipe including a garage with an opening;
- a logging tool disposed in the garage and extendable through the opening; and
- a protector fixably coupled to the garage adjacent the opening to prevent fluid communication through the opening and isolate the garage and the logging tool from well debris.

2. The pipe conveyed well logging assembly of claim 1 wherein the protector includes at least one flapper rotatably coupled to the garage to cover the opening.

3. The pipe conveyed well logging assembly of claim 1 wherein the protector includes a solid member filling the opening.

4. The pipe conveyed well logging assembly of claim 3 wherein the solid member includes an o-ring disposed between the solid member and the opening.

5. The pipe conveyed well logging assembly of claim 1 wherein the protector includes a destructible plug.

6. The pipe conveyed well logging assembly of claim 5 wherein the destructible plug includes a dissolvable material, a frangible material, or combinations thereof.

7. The pipe conveyed well logging assembly of claim 1 wherein the protector includes a closure device disposed in the opening below an atmospheric chamber.

8. The pipe conveyed well logging assembly of claim 7 wherein the atmospheric chamber is formed by a barrier that is breached by the extendable logging tool to communicate hydrostatic pressure to the closure device.

9. A pipe conveyed well logging assembly comprising:
- a downhole pipe including a garage with an opening;
- a logging tool disposed in the garage and extendable through the opening; and
- a moveable closure mechanism to, in a first position, enclose the logging tool in the garage and isolate the logging tool from well debris, and expose the logging tool to the well in a second position;
- wherein the closure mechanism prevents fluid communication through the opening.

10. The pipe conveyed well logging assembly of claim 9 wherein the closure mechanism includes at least one flapper rotatably coupled to the garage to cover the opening.

11. The pipe conveyed well logging assembly of claim 10 wherein the closure mechanism includes two interlocking flappers.

12. The pipe conveyed well logging assembly of claim 10 wherein the closure mechanism is releasably secured to the garage in the first position.

13. The pipe conveyed well logging assembly of claim 12 wherein the closure mechanism is biased to the first position when the logging tool is retracted, and releases to the second position in response to extension of the logging tool.

14. The pipe conveyed well logging assembly of claim 12 wherein the closure mechanism includes a drive mechanism to open the closure mechanism to the second position.

15. The pipe conveyed well logging assembly of claim 14 wherein the drive mechanism includes a worm gear, a spring, a motor, or combinations thereof.

16. The pipe conveyed well logging assembly of claim 9 wherein the closure mechanism is moveable from the second position to the first position.

17. A method of deploying a pipe conveyed well logging assembly comprising:
- disposing in a borehole a pipe including a garage housing a logging tool;
- lowering the logging tool below a selected well zone using the pipe;
- isolating the logging tool from the borehole using a closure member fixably coupled to the garage to prevent borehole debris from entering the garage;
- preventing fluid communication through an opening in the garage; and
- extending the logging tool through the opening in the garage.

18. The method of claim 17 further comprising moving the closure member with the logging tool to expose the logging tool to the borehole.

19. The method of claim 17 further comprising:
- destroying the closure member; and
- then extending the logging tool from the garage through an opening left by the closure member.

20. The method of claim 17 further comprising:

moving the closure member to expose an opening and the logging tool; and then extending the logging tool from the garage through the opening.

21. The method of claim 20 further comprising:

releasing the closure member to expose the logging tool to the borehole;

extending the logging tool from the garage; and moving the pipe and the logging tool up the borehole to log the well zone.

22. The method of claim 21 further comprising:

retracting the logging tool back into the garage; and moving the closure member to re-isolate the retracted logging tool from borehole debris.

* * * * *